US005238495A

United States Patent [19]

Madrzak

[11] Patent Number: 5,238,495

[45] Date of Patent: Aug. 24, 1993

[54] DOCTOR BLADE

[75] Inventor: Zygmunt Madrzak, Heidenheim, Fed. Rep. of Germany

[73] Assignee: J. M. Voith GmbH, Heidenheim, Fed. Rep. of Germany

[21] Appl. No.: 900,911

[22] Filed: Jun. 18, 1992

[30] Foreign Application Priority Data

Jun. 19, 1991 [DE] Fed. Rep. of Germany ..... 4120141

[51] Int. Cl.[5] ..... B05C 11/04; G03G 21/00

[52] U.S. Cl. ..... 118/261; 118/652; 355/299

[58] Field of Search ..... 355/253, 259, 299; 118/261, 413, 652, 653

[56] References Cited

U.S. PATENT DOCUMENTS 3,735,733 5/1973 Henc ..... 118/261
4,365,586 12/1982 Hosono et al. ..... 118/652
4,523,833 6/1985 Jones ..... 118/658 X
4,553,829 11/1985 Bares ..... 118/261 X
4,895,071 1/1990 Benton ..... 118/261 X

FOREIGN PATENT DOCUMENTS 1696226 8/1973 Fed. Rep. of Germany .
58-21278 2/1983 Japan .
61-156168 7/1986 Japan .

*Primary Examiner*—R. L. Moses
*Attorney, Agent, or Firm*—Baker & Daniels

[57] ABSTRACT

A doctor blade includes at least one row of openings extending across at least 10% of the blade width in an area representing the actual working width of the blade. The openings begin at a distance between 3 and 35 mm from the working edge of the blade. The openings may be formed as perforations, slots, or notches.

18 Claims, 1 Drawing Sheet

DOCTOR BLADE

BACKGROUND OF THE INVENTION

The present relates to a doctor blade, and, more particularly, to a doctor blade used for the coating of running material webs of paper o cardboard and for the dosing and smoothing of the coating mixture.

In a coating system for a material web used to apply high coating weights, it is rather difficult to achieve a constant coating weight across the width of the paper web.

What is needed in the art is a doctor blade providing relatively easy adjustment of the coating weight at high coating weights, and which further provides a relatively good and even coating application across the paper web width.

SUMMARY OF THE INVENTION

The present invention is directed to a doctor blade having a plurality of openings formed in the working section of the blade.

The present invention comprises, in one form thereof, a doctor blade including at least one row of openings extending across at least 10% of the blade width in an area representing the actual working width of the blade. The openings begin at a distance between 3 and 35 mm from the working edge of the blade. The openings may be formed as perforations, slots, or notches.

An advantage of the present invention is that relatively heavy doctor blades can be used so that the contact force is distributed over a larger area of the blade on its working edge, so that high coating weight is obtained at a relatively high contact force.

BRIEF DESCRIPTION OF THE DRAWINGS

The above-mentioned and other features and advantages of this invention, and the manner of attaining them, will become more apparent and the invention will be better understood by reference to the following description of embodiment of the invention taken in conjunction with the accompanying drawings, wherein.

Corresponding reference characters indicate corresponding parts throughout the several views. The exemplifications set out herein illustrate one preferred embodiment of the invention, in one form, and such exemplification are not to be construed as limiting the scope of the invention in any manner.

DETAILED DESCRIPTION OF THE INVENTION

Figure 4:
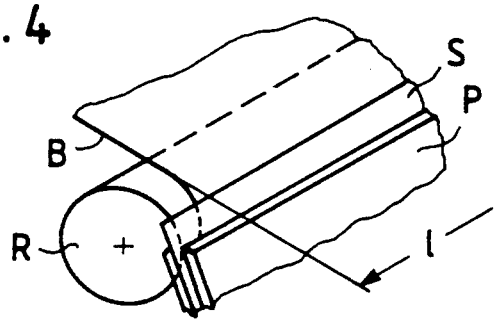
FIG. 4 is a perspective view of a coating system in which the present invention may be employed.

Referring now to the drawings, and particularly to FIG. 4, there is shown a coating system including a doctor blade, generally referenced S.

Figure 1:
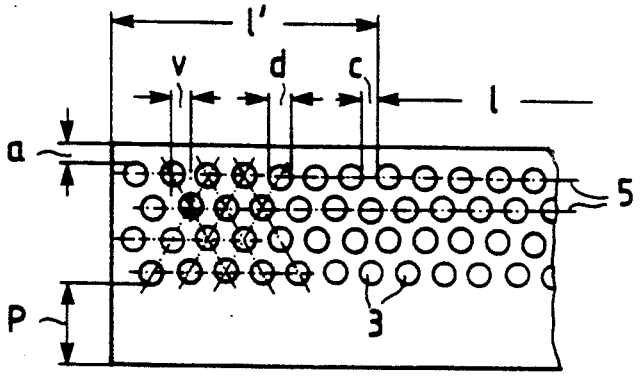
FIG. 1 is a fragmentary elevational view of one embodiment of the present invention.

As shown in FIG. 1, doctor blade S includes rows 5 of openings in the form of holes 3 formed therein. From row to row, the holes are spaced a distance "p" and within the row a distance "c". Naturally, it is advantageous to arrange the holes at a centered offset from row to row. The holes are not provided in an edge area of width "a" near the working edge 8 with the length 1. The width "a" may range between 3 and 35 mm. The hole diameter "d" is between 0.5 and 12 mm, preferably between 0.5 and 8 mm. The distance "c" between the holes in a particular row may be between 0.2 and 2.5 times, and is preferably between 0.4 and 1.5 times the hole diameter. Other widths "a", diameters "d", and distances "c", however, are possible. Starting at the beginning of the hole rows, i.e., from the end of the unperforated area adjacent the width "a", the hole diameters "d" may be increased gradually from row to row. The spacing "p" between the rows may also be reduced from row to row or, additionally or alone, the hole spacing "c" within the rows may be reduced.

The thickness of the doctor blade may be between 0.6 and 5 mm. Greater thicknesses are also possible. The blade is suitably fashioned perforated across the entire length, that is, $1+1'$. A still heavier perforation may be provided in the area 1', i.e., in the area situated outside the working area.

Figure 2A:
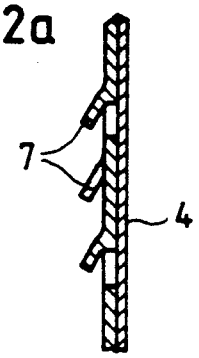
FIG. 2*a* is a side sectional view taken at section II in FIG. 2.
Figure 2:
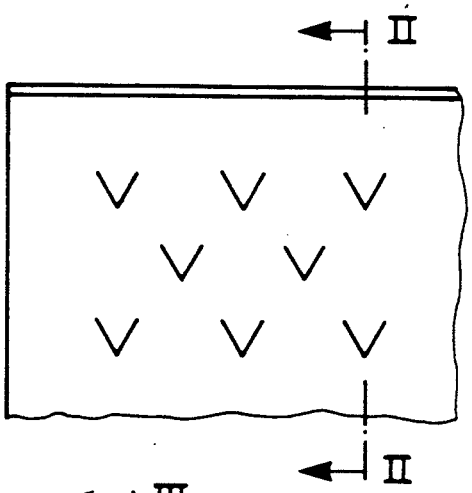
FIG. 2 is a fragmentary elevational view of another embodiment of the invention.

In FIGS. 2 and 2*a*, an alternative embodiment having triangular shaped openings is provided. The triangular shaped openings are formed by bending plate tongues 7 out of the base material. Plate tongues 7 may in certain systems prevent the coating mixture from proceeding through the holes to the other side of the blade. Otherwise, the perforated area formed by plate tongues 7 is covered, for instance, with a very thin adhesive foil 4. The holes may also be sealed with a paste. When arranging the holes in a regular pattern of equilateral triangles, the offset v of holes from row to row equals one-half the pitch in the rows, and the center spacing of such two holes equals 1.73 v.

Figure 3A:
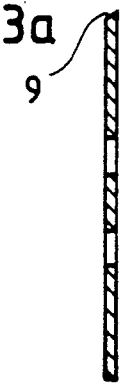
FIG. 3*a* is a side sectional view taken at section III in FIG. 3.
Figure 3:
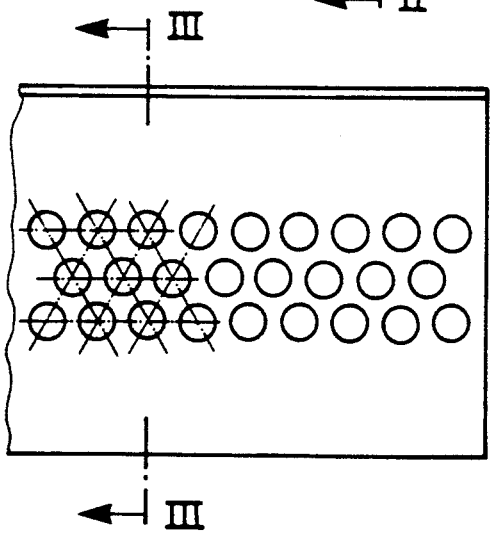
FIG. 3 is a fragmentary elevational view of another embodiment of the invention.

According to FIG. 3, three perforation rows are provided in a center area of the blade, based on its width. Also illustrated is a pointing 9 of the blade at the working edge. Pointing 9 may be necessary with a blade having a greater blade thicknesses.

FIG. 4 shows the overall arrangement of an exemplary coater with a roll R carrying a material web B, and with the doctor blade S fixed in the mounting P.

Figure 5:
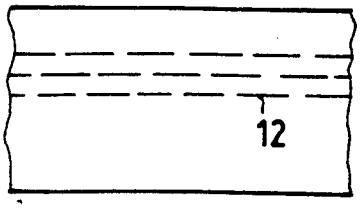
FIG. 5 is a fragmentary elevational view of an alternative embodiment of the present invention.

FIG. 5 illustrates an alternative embodiment wherein the doctor blade is formed with a plurality of slots or notches 12 arranged in rows parallel to the working edge and mutually offset from row to row. A pattern of notches or slots transverse to the illustrated direction is better though with respect to bending.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. In a coater for coating paper with coating mixture, a doctor blade having a working edge and coprising a plurality of openings extending across at least 10% of the width of the blade in the actual working width of the blade, said plurality of openings comprising at least three parallel rows of openings beginning at a distance between 3 and 35 mm from the working edge of the doctor blade wherein the holes are offset from row to row.

2. The doctor blade of claim 1, wherein said openings are covered by an adhesive strip.

3. The doctor blade of claim 1, wherein said rows respectively have a spacing therebetween which decreases from the working edge of the blade.

4. The doctor blade of claim 1, wherein said openings are formed across the entire length of the blade.

5. The doctor blade of claim 1, wherein said openings are perforations.

6. The doctor blade of claim 1 wherein said openings are slots.

7. The doctor blade of claim 1 wherein said openings are notches.

8. The doctor blade of claim 1, wherein the spacing between the rows is constant from centerline to centerline, and the diameter of the openings in each respective row increases as the distance of each row from the working edge of the blade increases.

9. The doctor blade of claim 1, wherein the spacing between the rows is constant from centerline to centerline, and the spacing between openings within each row decreases as the distance from the working edge of the blade increases.

10. The doctor blade of claim 1, wherein the edge area of blade disposed adjacent the working area has a greater number of openings than the working area.

11. The doctor blade of claim 1, wherein said openings are arranged in rows parallel to the working edge, said openings having a constant spacing therebetween and constant hole size per row.

12. The doctor blade of claim 1, wherein said openings have a diameter between 0.5 and 12 mm.

13. The doctor blade of claim 1, wherein said openings have a diameter between 0.5 and 8 mm.

14. The doctor blade of claim 1, wherein the spacing between said openings in said row is between 0.2 and 0.5 times the opening diameter.

15. The doctor blade of claim 1, wherein the spacing between said openings in said row ranges between 0.4 and 1.5 times the opening diameter.

16. The doctor blade of claim 1, wherein said openings are covered by an adhesive strip.

17. In a coater for coating paper with coating mixture, a doctor blade having a working edge and comprising a plurality of openings in a portion of the blade corresponding to the actual working width of the blade, said plurality of openings comprising at least three parallel rows of openings beginning at a distance of 3 to 35 mm from the working edge of the blade.

18. The doctor blade of claim 17, wherein each of said at least three parallel rows of openings are disposed offset relative to each other from row to row.

* * * * *